US006598767B2

(12) United States Patent
Baines et al.

(10) Patent No.: US 6,598,767 B2
(45) Date of Patent: Jul. 29, 2003

(54) DISPENSING CONTAINER

(75) Inventors: Roger Anthony Baines, Leeds (GB); Jonathan Justin Moore, Kingston-upon-Thames (GB)

(73) Assignee: Unilever Home & Personal Care USA division of Conopco Inc., Chicago, IL (US)

( * ) Notice: Subject to any disclaimer, the term of this patent is extended or adjusted under 35 U.S.C. 154(b) by 0 days.

(21) Appl. No.: 09/737,980

(22) Filed: Dec. 13, 2000

(65) Prior Publication Data

US 2001/0002962 A1 Jun. 7, 2001

Related U.S. Application Data

(63) Continuation of application No. 09/372,907, filed on Aug. 15, 1999.

(30) Foreign Application Priority Data

Aug. 14, 1998 (GB) ..... 9817813

(51) Int. Cl.[7] ..... A45D 40/06

(52) U.S. Cl. ..... 222/390; 604/311; 132/318; 132/320; 401/68; 401/175; D28/85

(58) Field of Search ..... 222/390; 604/289, 604/292, 309, 310, 311; 132/318, 320, 73, 73.5; 401/68, 72, 175; D28/85, 88

(56) References Cited

U.S. PATENT DOCUMENTS

| | | | | | |
|---|---|---|---|---|---|
| 2,336,328 | A | * | 12/1943 | Whalen | 132/320 X |
| 2,344,883 | A | * | 3/1944 | Kairalla | D28/85 X |
| 3,917,417 | A | * | 11/1975 | Lang | 401/72 |
| 5,725,133 | A | * | 3/1998 | Iaia | 222/390 |
| 5,819,993 | A | * | 10/1998 | Wile | 222/390 |
| 5,961,007 | A | * | 10/1999 | Dornbusch et al. | 222/390 X |

* cited by examiner

*Primary Examiner*—Kenneth Bomberg
(74) *Attorney, Agent, or Firm*—Kevin J. Stein

(57) ABSTRACT

A dispensing package for a cosmetic stick comprising a barrel having a generally open end and a generally closed end, a central longitudinal axis which run between the generally open end and the generally closed end of the barel, a piston slidably located within the barrel for advancing product contained within the barrel towards the generally open end, the package having a cross-section perpendicular to the central longitudinal axis which is ellipsoidal, the generally open end of the package ending in an opening through which product contained in the dispenser can be dispensed, characterized in that the opening, when viewed in the direction of the minor axes of the ellipsoidal cross-section, is concave.

7 Claims, 2 Drawing Sheets

DISPENSING CONTAINER

This is a continuation of Ser. No. 09/372,907 filed Aug. 15, 1999.

This invention relates to dispensing containers. In particular, it relates to dispensing containers which may be of use for dispensing cosmetic stick products, such as antiperspirant or deodorant sticks.

Cosmetic stick containers for such products are known, and typically consist of a barrel in which the stick composition may be contained, which is typically made from a plastics material. The barrel may have a variety of cross-sectional shapes, but most popular are circular and ellipsoidal. The container will typically have a detachable cap to protect the contents from the undesirable effects of prolonged exposure to air, and an elevation mechanism by which the contents of the container are elevated towards the open top end of the pack, in order that a portion of the stick may protrude from the top of the container to facilitate use.

Whilst most containers have a generally flat opening when seen from the side, it is also known for cosmetic containers to have a convex profile. For example, U.S. Pat. No. 5,275,496 describes a cosmetic stick package which is generally ellipsoidal in cross-sectional shape, and has an outwardly arched profile when viewed along the minor axes of the ellipsoid. Such a profile is said to facilitate in providing increased comfort of these stick products during application, and is also said to provide extra support for the stick so as to prevent crumbling on application.

A further teaching of this patent is directed towards a relatively wide applicator surface, which extends around the entire periphery of the opening of the pack, and is said to facilitate application of the cosmetic stick product. In particular, the provision of the relatively wide applicator surface is said to prevent pinching of a user's skin, which alleged to happen and be uncomfortable for the user should the package have a relatively narrow, sharp edge adjacent the top opening, and the stick be used down to the point where the opening of the container may protrude, beyond the application surface of the stick, thereby allowing the package to make contact with the user's skin in use.

(Societe Fermiere Pinaud) describes a cosmetic container for a hair dressing product which has a cross section which is generally rectangular, and which has an opening on top of the container which is generally concave when viewed from the side. The stick hair dressing product also has a concave surface; the combined shape of the top of the package and the top of the stick is said to facilitate application of the dressing to head hair.

It is an object of the invention to provide a dispensing stick package which prevents the user from catching his or herself on the edges of the pack during application, thereby improving comfort of the package during use.

Thus, according to a first aspect of the invention, there is provided a package for a cosmetic stick comprising a barrel having a generally open end and a generally closed end, a central longitudinal axis which runs between the generally open end and the generally closed end of the barrel, a piston slidably located within the barrel for advancing product contained within the barrel towards the generally open end, the package having a cross-section perpendicular to the central longitudinal axis which is ellipsoidal, the generally open end of the package ending in an opening through which product contained in the dispenser can be dispensed, characterised in that the opening, when viewed in the direction of the minor axes of the ellipsoidal cross-section, is concave.

Dispensing packages according to the invention have been found to be particularly suitable for antiperspirant and deodorant sticks, since by virtue of having a concave side profile, this has been found to reduce or eliminate problems associated with the scraping of sharp sides of the dispensing package against the skin, since the package is cut away in this particular area, and hence there is no part of the pack side wall to abrade against skin, and a reduced chance of abrasion occurring.

However, whilst providing a cut away portion (by virtue of the concave profile of the pack) which prevents contact of the package against the skin in use, the profile of the package means that the ends of the pack generally rise up relative to the sides, and provide support to the stick contained therein. This extra support may be useful to prevent crumbling or general disintegration of the cosmetic stick contained therein.

In a preferred embodiment, the dispensing package is of the type where stick product contained in the package is advanced by a screw feed mechanism, being mounted on a piston head having a central channel, which is conveniently mounted on a central spindle located coaxially with the central longitudinal axis of the package. Typically, the spindle is rotationally secured to the package. Conveniently, the piston may be caused to elevate and retract within the package by means of co-operating screw threads located on the central spindle and the central channel on the piston head, and may be operated by means of a thumbwheel located at one end of the central spindle, typically adjacent the bottom of the package. The Thumbwheel can be of any appropriate dimensions, as long as it serves to allow the user to elevate the piston on which the cosmetic stick is mounted.

According to a further aspect of the invention, there is provided a packaged cosmetic stick product comprising a cosmetic stick product packaged in a dispensing package as described above. Preferably, the cosmetic stick product is an antiperspirant or deodorant stick product.

In a highly preferred embodiment, the dispensing package may have, adjacent its widest parts, (ie towards the ends), areas adjacent the dispensing package opening in which the walls of the package are generally more rounded, and are typically wider and/or thicker than the sides (i.e. adjacent the ends of the minor axes of the ellipsoidal cross section) of the container barrel.

Such parts of the container opening may be generally more rounded or have a larger radius of curvature than those parts of the container opening which are adjacent the minor axes of the ellipsoidal cross section container (ie the sides), or may generally be thicker. In any event, such parts of the container are dimensioned and profiled such that in the event of contact between these parts of the container and a user's skin, the container does not scrape the skin, or provide a sensation of scraping.

Such generally more rounded portions need not actually be used as an aid to applying and rubbing in the cosmetic product applied, or reduce drag on application, as described in EP 355,156 discussed above.

Such additionally rounded portions of the container, when utilized, extend not around the entire periphery of the container opening, but are confined to the ends of the container, i.e. the widest spaced parts of the ellipsoidal cross section containers. Conveniently, the additionally rounded or thicker or wider parts of the container opening are confined to no more than one third of the dimensions of the major axis of the ellipsoidal cross section container, measured from each end of the container, and extending along the sides of the container. Hence the wall of the container adjacent the ends of the minor axes of the elliptical container is preferably of traditional thin wall construction for at least one third of the width of the container (the width being the length of the major axes of the ellipsoidal cross section container), on each side of the container.

Packages according to the invention have been found to have excellent properties with regard to comfort on application of the cosmetic stick. In particular, since antiperspirant and deodorant stick products are typically applied in a sweeping motion, sweeping the broadest width of the stick across the axilla, the absence of a high sided wall on the package, by virtue of the concave profile, reduces incidences of catching of the stick package against the skin, thereby causing unpleasant abrasion. Further, in embodiments where the widely spaced ends of the package are generally more rounded or thicker than the package side wall, this has been found to further improve comfort on application, and minimise abrasion for the user.

Packages according to the invention have also been found to have further advantages. In particular, cosmetic stick products (especially antiperspirant and deodorant stick products) have been found to be easier to apply in packages according to the invention compared to other known dispensing packages, since the concave profile of the package means that in practice a user is able to hold the product a greater variety of angles relative to the skin surface to which the product is being applied, and apply it without sensing abrasion, compared to a conventional stick package. Such an advantage facilitates product application.

A further advantage of dispensing packages according to the invention is that, as the contents of the package are about to run out, the user may be provided with a visual signal that this is about to happen, by virtue of the piston on which the cosmetic stick is mounted becoming visible at the dipping sides of the package. This effect may be further accentuated by for example making the piston visually distinctive by being for example either coloured or patterned, or convex when viewed from the side, or a combination of the two.

Further, since in use antiperspirant or deodorant sticks tend to naturally adapt a convex profile after several applications, the use of a convex topped piston may maximise the amount of product which can actually be used by the user before the product is fully used.

The invention will now be further described by way of example only, with reference to the accompanying drawings in which.

Figure 1:
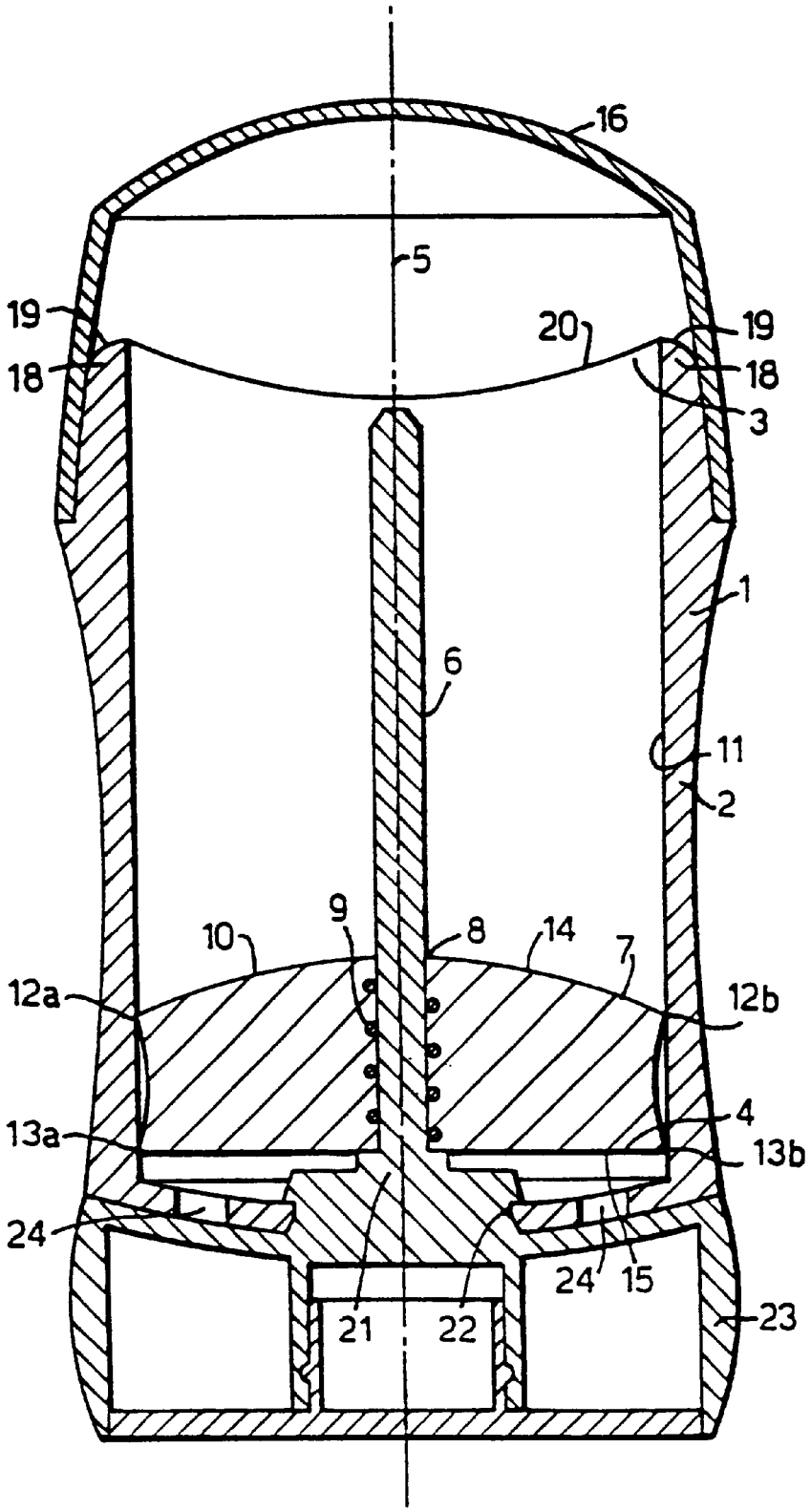
FIG. 1 shows a cross sectional view of a package according to the invention.
Figure 2:
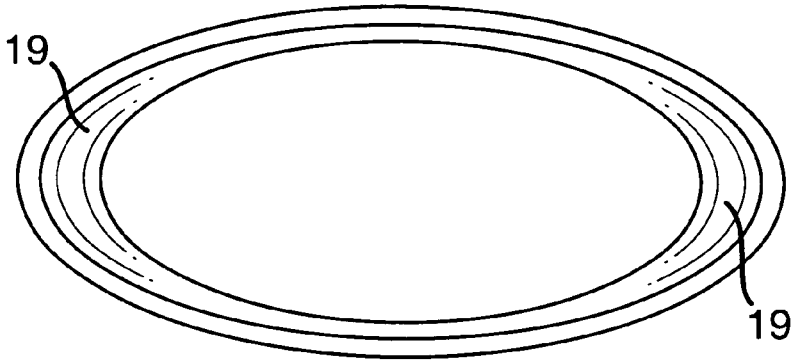
FIG. 2 shows a top view of a package without a cap containing a stick according to the invention.
Figure 3:
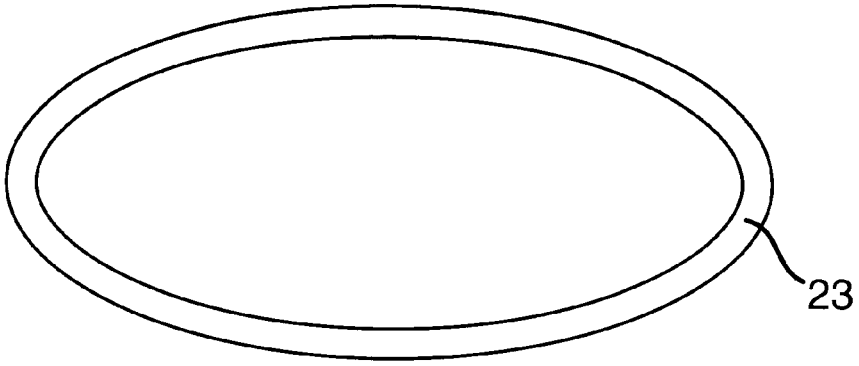
FIG. 3 shows a bottom view of a package according to the invention wherein like numerals indicate the same elements.

Referring to FIG. 1, the package 1 comprises a barrel 2 having a generally open end 3 and a generally closed end 4. A central longitudinal axis 5 runs between the generally open end 3 and generally closed end 4. Generally open end 3 of the package 1 results in a package opening 20. Coaxial with central longitudinal axis 5 is spindle 6, which has located on its outer surface a screw thread (not shown). Mounted on the spindle is piston 7, which has a central channel 8 in which is integrally moulded a screw thread 9. In use, screw thread 9 interacts with the screw thread on spindle 6 such that piston 7 can be caused to move up and down the package, either close to or further away from generally open end 3 by causing the spindle 6 to rotate.

Piston 7 has an upper surface 10 which is concave in shape, and on which rests in use the cosmetic stick to be dispensed (not shown).

Package 1 is ellipsoidal in cross section shape, and also when viewed from above. Package 1 also has an inner surface 11 to the barrel 2, which has parallel sided walls, even though the outer surface of the package 1 is shown as having curved outer sides, with a waist portion adjacent the middle of the barrel 2. Piston 7 has dimensions such that it is slightly smaller in dimensions than the inner suface 11 of barrel 2, but nevertheless makes intimate and close sliding contact with inner surface 11 by means of wiper surfaces 12*a*, 12*b*, 13*a*, 13*b*, which are located on the leading surface 14 and the rear surface 15 respectively of piston 7.

Package 2 has a top cap 16, which is located on top of package 1 adjacent the generally open end 3, and which helps protect the contents of the package from the deleterious effects of contact with air, such as drying out of the cosmetic stick. Cap 16 conveniently has co-operating means on it and the upper portion of barrel 2 which enable the cap to be releasably retained on the top of barrel 2; these can readily take the form of a snap fit mechanism on the appropriate surfaces of the cap and barrel, to facilitate retention of the cap 16 on the barrel 2, but nevertheless readily permit its release when required.

Packages according to this embodiment may also advantageously be used in conjunction with a former (not shown). Use of a former helps in keeping the cosmetic skick isolated from air after manufacture but before first use by the user, and also facilitates manufacture and casting of the upper surface of the cosmetic stick, where for example the cosmetic stick is manufactured according to the known process whereby the stick is molten cast and bottom filled into the empty package. If used, the former is preferably configured so as to releasably and snugly fit into package opening 20 prior to manufacture, but then to be readily removed and discarded on first use.

Adjacent the generally open end 3 of the package 2, the end 18 is shown as having a relatively rounded surface 19, which is wider than the sides of the container adjacent the minor axes of the ellipsoidal (when viewed from above) top. This profile of end surface may act to improve the comfort of the user during application of the cosmetic stick. However, the relatively rounded surface 19 is confined to the ends 18 of the package, and typically extends no further than one third of the width of the package 1, along the sides of package opening 20, in which the generally open end 3 terminates.

Spindle 6 is attached to central body 21, and is conveniently integrally moulded with it. Central body 21 is retained in orifice 22 in generally closed end 4 of the package, in such a way that it may rotate within the orifice 22, and may therefore cause spindle 6 to rotate. In this embodiment, central body 21 is attached to rotatig member 23, which is a separately moulded piece, and is attached to it, for example by ultrasonic welding. Rotating member 23 acts as a thumbwheel for causing rotation of the spindle 6, and conveniently takes the form of a member which has an outer surface and cross sectional profile which is not simply circular, but which has a profile which is generally ellipsoidal in cross section, and is generally similar in profile to that of the rest of the package. The outer suface of the rotating member 23 may also have features which either facilitate its use or enhance its aesthetic appeal, such as for example grip portions on the outer suface (not shown).

Generally closed end 4 has located therein filling holes 24, which facilitate bottom filling of the package with molten material, but which may subsequently be sealed during the manufacturing process once molten cosmetic stick is dosed.

In the package exemplified, all parts of the package may be made from plastics materials, and may be manufactured and assembled by known techniques, which may for example involve injection moulding. Where possible and convenient, the component parts of the package may be integrally moulded.

In manufacture of the cosmetic product, a cosmetic stick composition such as an antiperspirant or deodorant stick formulation may be dosed into the package, for example by dosing it molten into a generally assembled upturned package of the type shown in FIG. 1, except prior to the attachment of rotating member 23. The formulation can be dosed through filling holes 24, and will run past piston 7, which conveniently has channels in it through which the formulationn may flow (not shown). When a correct amount is dosed, filling holes 24 are sealed, and rotating member 23 attached, for example by snap fitting it into orifice 22 in which it is retained. The cosmetic product is then left to cool, and the dosed product allowed to set.

In use, cap 16 and former (if used) are removed, and rotating member 23 is rotated such that piston 7 is advanced towards generally open end 3, and the cosmetic stick product is caused to protrude from package opening 20. After use and if requird, the stick can be retracted into the container by appropriate contra-rotation of rotating member 23.

What is claimed is:

1. A packaged cosmetic stick product comprising a cosmetic stick packaged in a dispensing package for a cosmetic stick comprising a barrel having a generally open end and a generally closed end, a central longitudinal axis which runs between the generally open end and the generally closed end of the barrel, a piston slidably located within the barrel for advancing product contained within the barrel towards the generally open end, the package having a cross-section perpendicular to the central longitudinal axis which is ellipsoidal, the generally open end of the package ending in an opening through which product contained in the dispenser can be dispensed, wherein the opening, when viewed in the direction of the minor axes of the ellipsoidal cross-section, is concave and wherein said cosmetic stick is an antiperspirant or deodorant stick.

2. A packaged cosmetic stick product according to claim 1, wherein said package opening has a greater thickness at its widest spaced parts of said ellipsoidal cross section perpendicular to said central longitudinal axis, relative to the thickness of said package opening adjacent ends of said minor axis of said ellipsoidal cross section perpendicular to said central longitudinal axis.

3. A packaged cosmetic stick product according to claim 1, wherein the piston has a convex profile.

4. A packaged cosmetic stick product according to claim 1, wherein the piston advances by a screw feed mechanism.

5. A packaged cosmetic stick product according to claim 4, wherein the piston has a central channel which is mounted on a central spindle which is located coaxially with the central longitudinal axis of the package.

6. A packaged cosmetic stick product according to claim 5, wherein said spindle is attached to a central body and integrally moulded with said central body.

7. A dispensing package for a cosmetic stick comprising a barrel having a generally open end and a generally closed end, a central longitudinal axis which runs between the generally open end and the generally closed end of the barrel, a piston slidably located within the barrel for advancing product contained within the barrel towards the generally open end, the package having a cross-section perpendicular to the central longitudinal axis which is ellipsoidal, the generally open end of the package ending in an opening through which product contained in the dispenser can be dispensed, wherein the opening, when viewed in the direction of the minor axes of the ellipsoidal cross-section, is concave and said dispensing package having a thumbwheel which is ellipsoidal in cross section and generally similar in profile to the rest of the package.

* * * * *